US005743971A

United States Patent [19]

Inoue et al.

[11] Patent Number: 5,743,971

[45] Date of Patent: Apr. 28, 1998

[54] LIQUID RUST PROOF FILM-FORMING COMPOSITION AND RUST PROOF FILM-FORMING METHOD

[75] Inventors: Manabu Inoue; Tadahiro Ohnuma; Tomitaka Yamamoto; Go Sato, all of Tokyo, Japan

[73] Assignee: Dipsol Chemicals Co., Ltd., Tokyo, Japan

[21] Appl. No.: 683,472

[22] Filed: Jul. 18, 1996

[30] Foreign Application Priority Data

Aug. 21, 1995 [JP] Japan ..... 7-211585

[51] Int. Cl.[6] ..... C23C 27/78

[52] U.S. Cl. ..... 148/247; 148/273

[58] Field of Search ..... 148/273, 247

[56] References Cited

U.S. PATENT DOCUMENTS

| | | |
|---|---|---|
| 4,349,392 | 9/1982 | Huvar . |
| 4,384,902 | 5/1983 | Crotty et al. . |
| 5,221,371 | 6/1993 | Miller . |
| 5,356,492 | 10/1994 | Miller . |

FOREIGN PATENT DOCUMENTS

| | | |
|---|---|---|
| 0 488 353 | 6/1992 | European Pat. Off. . |
| 0 694 593 | 1/1996 | European Pat. Off. . |
| 52-92836 | 8/1977 | Japan . |
| 57-145987 | 9/1982 | Japan . |
| 2 097 024 | 10/1982 | United Kingdom . |
| WO 95/04169 | 2/1995 | WIPO . |
| WO 95/09934 | 4/1995 | WIPO . |

*Primary Examiner*—Sam Silverberg

*Attorney, Agent, or Firm*—Oblon, Spivak, McClelland, Maier & Neustadt, P.C.

[57] ABSTRACT

A liquid rust proof film-forming composition comprises (A) an oxidative substance, (B) a silicate and/or silicon dioxide and (C) at least one member selected from the group consisting of metal cations of Ti, Zr, Ce, Sr, V, W and Mo; and oxymetal anions and fluorometal anions thereof. The composition can be used in a method for forming a rust proof film on a metal substrate which comprises the step of immersing the metal substrate in the composition. The composition and the methods form an excellent rust proof film on the surface of metal substrates without using any chemical substance harmful to environment such as hexavalent chromium.

9 Claims, No Drawings

LIQUID RUST PROOF FILM-FORMING COMPOSITION AND RUST PROOF FILM-FORMING METHOD

BACKGROUND OF THE INVENTION

The present invention relates to a rust proof film-forming method for treating the surface of metal materials to thus effectively keep the same from rusting and a liquid rust proof film-forming composition for use in the method.

There have been used a solution containing hexavalent chromium in most of the conventionally proposed techniques for treating the surface of metals to thus effectively keeping the metal surface from rusting. The hexavalent chromium is a quite efficient rust proofing agent, but is highly toxic and adversely affects environment and human health. For this reason, there have been proposed a variety of methods for preventing rusting without using hexavalent chromium.

For instance, Japanese Un-Examined Patent Publication (hereinafter referred to as "J. P. KOKAI") No. Sho 52-92836 discloses a method for forming a conversion film on the surface of zinc and zinc alloys by treating the surface with an aqueous solution comprising titanium ions and at least one member selected from the group consisting of phosphoric acid, phytic acid, tannic acid and hydrogen peroxide and J. P. KOKAI No. Sho 57-145987 discloses a method for forming a conversion film on the surface of aluminum and aluminum alloys by treating the same with an aqueous solution comprising, as principal components, a silicate and a zinc compound. However, these methods do not necessarily impart sufficient corrosion resistance practically acceptable to the metal surface and cannot supersede the treating methods using hexavalent chromium.

SUMMARY OF THE INVENTION

Accordingly, it is an object of the present invention to provide a liquid rust proof film-forming composition capable of forming an excellent rust proof film on the surface of metal substrates, which is free of any chemical substance harmful to environment such as hexavalent chromium.

Another object of the present invention is to provide a method for forming an excellent rust proof film on the surface of metal substrates without using such chemical substances.

These and other objects of the present invention will be apparent from the following description and examples.

The present invention has been developed on the basis of such findings that an excellent rust proof film can be obtained by immersing a metal substrate in an aqueous solution comprising an oxidative substance, a silicate and/or silicon dioxide and specific metal ions and optionally oscillating or stirring the solution and that the corrosion resistance of the metal substrate can further be improved by applying an overcoat using, for instance, a colloidal silica-containing acrylic resin solution.

According to an aspect of the present invention, there is thus provided a liquid rust proof film-forming composition which comprises (A) an oxidative substance, (B) a silicate and/or silicon dioxide, and (C) at least one member selected from the group consisting of metal cations of Ti, Zr, Ce, Sr, V, W and Mo; oxymetal anions thereof; and fluorometal anions thereof.

According to another aspect of the present invention, there is also provided a method for forming a rust proof film which comprises the step of immersing a metal substrate in the foregoing liquid rust proof film-forming composition to form a rust proof film on the surface of the metal substrate.

According to a further aspect of the present invention, there is provided a metal surface-treating method which comprises the steps of forming a rust proof film on a metal substrate by the aforementioned method and then overcoating the substrate with an inorganic or organic rust proof film.

DESCRIPTION OF THE PREFERRED EMBODIMENTS

The present invention will hereinafter be described in detail with reference to the following preferred embodiments.

Examples of the oxidative substances used in the liquid rust proof film-forming composition of the invention include peroxides and nitric acid. Specific examples of such peroxides include hydrogen peroxide, sodium peroxide and barium peroxide. Specific examples thereof usable herein also include peroxo acids and salts thereof such as performic acid, peracetic acid, perbenzoic acid, ammonium persulfate and sodium perborate. Among these, preferred is hydrogen peroxide and the use of 35% hydrogen peroxide is practically preferred.

The overall concentration of the oxidative substance in the composition ranges from 0.001 to 3.0 mole/l and more preferably 0.01 to 1.0 mole/l.

Examples of silicates used in the composition of the invention are alkali metal salts and ammonium salts such as lithium silicate, sodium silicate and potassium silicate, with sodium and potassium silicates being preferably used from the practical standpoint. Moreover, preferred silicon dioxide is colloidal silica. The concentration of the silicate and/or silicon dioxide preferably ranges from 0.001 to 2.0 mole/l and more preferably 0.05 to 1.0 mole/l.

Examples of ionic species of metals usable in the present invention are Ti, Zr, Ce, Sr, V, W and Mo and any combination thereof. Specific examples of each ionic species are as follows.

Examples of Ti ion sources are fluoro-titanic acid and salts thereof such as titanium hydrofluoride, ammonium fluoro-titanate and sodium fluoro-titanare and titanium salts such as titanium chloride and titanium sulfate, which may be used alone or in any combination.

Examples of Zr ion sources are fluorozirconic acid and salts thereof such as $H_2ZrF_6$, $(NH_4)_2ZrF_6$ and $Na_2ZrF_6$; zirconyl salts such as zirconyl sulfate and zirconyl oxychloride; and zirconium salts such as $Zr(SO_4)_2$ and $Zr(NO_3)_2$, which may be used alone or in any combination.

Examples of Ce ion sources include cerium chloride, cerium sulfate, cerium perchlorate, cerium phosphate and cerium nitrate, which may be used alone or in any combination.

Examples of Sr ion sources are strontium chloride, strontium fluoride, strontium peroxide and strontium nitrate, which may be used alone or in any combination.

Examples of V ion sources include vanadates such as ammonium vanadate and sodium vanadate; oxyvanadates such as vanadium oxysulfate; fluorides of vanadium and salts thereof such as vanadium fluoride, which may be used alone or in any combination.

Examples of W ion sources include tungstates such as ammonium tungstate and sodium tungstate and mixture thereof.

Examples of Mo ion sources are molybdates such as ammonium molybdate and sodium molybdate; and phosphomolybdates such as sodium phosphomolybdate, which may be used alone or in any combination.

Ti ions are most preferably used in the composition of the invention among others. The total amount of these metal ions present therein preferably ranges from 0.0001 to 0.5 mole/l and more preferably 0.001 to 0.05 mole/l.

In the present invention, the most preferred liquid rust proof film-forming composition is an aqueous solution comprising hydrogen peroxide, a silicate and a titanium compound.

The rust proof film-forming composition of the invention in general has a pH value falling within the range of from 0.5 to 6.0 and preferably 1.5 to 3.0. The pH value thereof can be adjusted by addition of an acid or an alkali. Specific examples of acids include mineral acids such as phosphoric acid, sulfuric acid, hydrochloric acid and nitric acid, while specific examples of alkalis are alkali metal hydroxides such as sodium and potassium hydroxides and aqueous ammonia.

Moreover, the composition of the invention preferably comprises a chelating component capable of solubilizing metal ions in the composition. Examples of such chelating components are aliphatic amines such as ethylenediamine, diethylenetriamine and trimethyltetramine; aminoalcohols such as triethanolamine; aminocarboxylic acids such as EDTA, NTA, glycine and aspartic acid; hydroxycarboxylic acids such as glycollic acid, lactic acid, tartaric acid, malic acid, citric acid and tartrylgluconic acid; and acids, for instance, monocarboxylic acids such as formic acid, acetic acid and propionic acid and polyvalent carboxylic acids such as malonic acid, succinic acid, maleic acid and diglycolic acid as well as alkali metal salts and ammonium salts thereof. These chelating agents may be used alone or in any combination.

The kind and concentration of such chelating component are preferably selected while taking into consideration the kind and concentration of specific metal ions used. In particular, the overall concentration: C (mole/l) of the chelating components is preferably determined on the basis of the ratio thereof to the concentration: M (mole/l) of metal ions used and the ratio (C/M) is preferably not more than 50/1.

If Ti ions are selected as the component (C) of the composition, the chelating agents preferably used are diglycollic acid, malonic acid or salts thereof.

In addition, the conversion treatment solution of the present invention may comprise a nitrogen atom-containing compound for the stabilization of the silicate component present in the bath. Among the nitrogen atom-containing compounds, particularly preferred are carbonyl group-containing heterocyclic compounds such as N-methyl-2-pyrrolidone, ε-caprolactam, 1,3-dimethyl-2-imidazolidone, 2-pyrrolidone and caffeine. The content thereof in the treating solution preferably ranges from 0.01 to 0.1 mole/l. The balance of the liquid rust proof film-forming composition of the invention is preferably water.

A rust proof film can be formed on the surface of a metal substrate by applying the foregoing liquid rust proof film-forming composition onto the metal substrate. Preferably, the subject to be treated is immersed in the treating solution. The temperature for treating the metal substrate surface with the composition is not restricted to a specific range, but preferably 20°to 50° C. from the practical standpoint. In addition, the treating time is not likewise limited to any specific range, but it desirably ranges from 5 to 180 seconds.

The composition and method according to the present invention permit the formation of the foregoing rust proof film on any kind of metal substrate, but they are preferably applied to substrates of metals selected from the group consisting of Zn, Ni, Cu, Ag, Fe, Cd, Al, Mg and alloys thereof. In this respect, examples of such alloys include Zn-Ni alloys, Zn-Fe alloys, Zn-Sn alloys and Ni-P alloys, with metal substrate provided thereon with Zn and Zn alloy-plating films being most preferred in the present invention.

The rust proof film to be formed is not limited in its thickness. In general, however, the thickness thereof is desirably on the order of from 0.01 to 1 μm.

According to the present invention, the foregoing rust proof film may further be overcoated with an inorganic or organic rust proof film. The overcoat used herein is not particularly restricted, but may be currently used inorganic or organic rust proof films such as those formed from colloidal silica, acrylic resins, silane coupling agents, silicates, epoxy resins and urethane resins, with those comprising water soluble acrylic resins, which contain 10 to 30% by weight of colloidal silica, being preferred from the practical point of view.

Moreover, the metal substrate thus treated may further be subjected to coating treatments by, for instance, cationic electrodeposition, anionic electrodeposition or electrostatic spray coating, since such a coated film may also serve as surface preparation for paint and coating. Thus, the resulting substrate would further be improved in the corrosion resistance.

As has been described above in detail, the composition and methods of the present invention permit the formation of an excellent rust proof film on the surface of metal substrates without using any chemical substance harmful to environment such as hexavalent chromium.

The present invention will further be described in more detail with reference to the following working Examples and Comparative Examples.

EXAMPLE 1

A specimen was first prepared by applying a zinc or zinc alloy (an alloy comprising 30 to 99.5% by weight of zinc and 0.5 to 70% by weight of other components) plating film having a thickness ranging from 8 to 10 μm onto the surface of an SPCC-polished steel plate (plate thickness: 0.3 mm; 100 mm×65 mm). Then the specimen was immersed in each rust proof film-forming solution No. 1 to 12 according to the present invention specified in Table 1 at 25° C. for 60 seconds followed by withdrawing the specimen, water-washing and drying the same.

Each specimen which had been subjected to the foregoing treatment was subjected to the salt spray test according to JIS Z2371 for evaluating the corrosion resistance thereof.

More specifically, the specimen was evaluated on the basis of the time required till the amount of white rust (the rate of the total area gathering white rust with respect to the total area of each specimen) exceeded 5%. The results thus obtained are summarized in the following Table 2.

TABLE 1

| Bath Component (g/l) | No. 1 | No. 2 | No. 3 | No. 4 | No. 5 | No. 6 |
|---|---|---|---|---|---|---|
| Kind of Plating | Zn | Zn | Zn | Zn | Sn—Zn | Zn |
| 35% $H_2O_2$ | 50 | 50 | 25 | 40 | 100 | 2 |
| 62% $HNO_3$ | — | — | — | — | — | 20 |
| potassium silicate | 10 | — | 40 | — | — | 40 |
| sodium silicate | — | 50 | — | — | 70 | 40 |
| colloidal silica | — | — | — | 10 | — | — |
| 20% titanium chloride soln. | 10 | — | — | — | — | 1 |
| 25% titanium sulfate soln. | — | 6 | — | — | — | — |
| zirconium oxychloride | — | — | 12 | — | 10 | — |
| cerium nitrate | — | — | — | 5 | — | — |
| ammonium vanadate | — | — | — | — | — | 5 |
| diglycollic acid | — | 2 | — | — | — | — |
| glycine | — | — | — | — | 2 | — |
| lactic acid | — | — | 10 | — | — | — |
| sodium succinate | — | — | 5 | — | — | — |
| pH | 1.6 | 1.6 | 1.8 | 3.0 | 2.8 | 3.7 |
| (pH-adjustinq agent) | $H_2SO_4$ | $H_2SO_4$ | HCl | $H_2SO_4$ | $H_2SO_4$ | NaOH |

| Bath Component (g/l) | No. 7 | No. 8 | No. 9 | No. 10 | No. 11 | No. 12 |
|---|---|---|---|---|---|---|
| Kind of Plating | Zn—Ni | Zn | Zn—Co | Zn | Zn | Zn |
| 35% $H_2O_2$ | 1 | 2 | 50 | 40 | — | 1 |
| 62% $HNO_3$ | — | 2 | — | — | — | 2 |
| sodium peroxide | — | — | — | — | 10 | — |
| potassium silicate | — | 20 | 25 | — | 40 | — |
| sodium silicate | 150 | — | — | 20 | — | — |
| colloidal silica | — | — | — | — | — | 30 |
| 20% titanium chloride soln. | — | 1 | — | 15 | 5 | 3 |
| 25% titanium sulfate soln. | — | — | 10 | — | — | — |
| sodium fluoro-titanate | 5 | — | — | — | — | — |
| zirconium oxychloride | — | — | — | 0.1 | — | — |
| strontium chloride | — | 1 | — | — | — | — |
| sodium tungstate | — | — | 5 | — | — | — |
| sodium phosphomolybdate | — | — | — | — | 2 | — |
| EDTA | — | — | 0.5 | — | — | — |
| glycine | — | — | — | 10 | — | — |
| malonic acid | — | 1 | — | — | — | — |
| pH | 4.0 | 2.5 | 2.0 | 4.5 | 1.5 | 0.9 |
| (pH-adjusting agent) | $H_2SO_4$ | $H_2SO_4$ | $H_2SO_4$ | aq.$NH_3$ | $H_2SO_4$ | $H_2SO_4$ |

TABLE 2

| | Salt Spray Test Results (5% white rust-forming time (hr)) | | | | | | | | | | | |
|---|---|---|---|---|---|---|---|---|---|---|---|---|
| Bath No. | 1 | 2 | 3 | 4 | 5 | 6 | 7 | 8 | 9 | 10 | 11 | 12 |
| (hr) | 168 | 168 | 144 | 144 | 144 | 168 | 168 | 168 | 144 | 168 | 168 | 168 |

COMPARATIVE EXAMPLE 1

The same specimen used in Example 1 was immersed in each comparative treating solution No. 13 to 16 specified in Table 3 at 25° C. for 60 seconds, followed by withdrawing, water-washing and drying the specimen.

The specimens thus treated were inspected for the corrosion resistance by the same method used in Example 1. The results obtained are summarized in the following Table 4.

TABLE 3

| | Comparative Treating Solution | | | |
|---|---|---|---|---|
| Bath Component (g/l) | No. 13 | No. 14 | No. 15 | No. 16 |
| Kind of Plating | Zn | Zn | Zn | Zn—Ni |
| 35% $H_2O_2$ | 50 | 2 | — | 20 |
| 62% $HNO_3$ | — | 2 | — | — |

TABLE 3-continued

| | Comparative Treating Solution | | | |
|---|---|---|---|---|
| Bath Component (g/l) | No. 13 | No. 14 | No. 15 | No. 16 |
| potassium silicate | 10 | — | — | — |
| sodium silicate | — | — | 50 | — |
| 20% titanium chloride soln. | — | 1 | 2 | — |
| zirconium oxychloride | — | — | — | 5 |
| pH | 2.0 | 2.0 | 1.8 | 2.5 |
| (pH-adjusting agent) | $H_2SO_4$ | $H_2SO_4$ | $H_3PO_4$ | $H_2SO_4$ |

TABLE 4

| Bath No. | 13 | 14 | 15 | 16 |
|---|---|---|---|---|
| 5% White Rust-Forming Time (hr) | 6 | 24 | 3 | 6 |

COMPARATIVE EXAMPLE 2

The same specimen used in Example 1 was subjected to a colorless chromate treatment, followed by withdrawing the specimen from the treating bath, water-washing and drying the same.

The specimen thus treated was inspected for the corrosion resistance by the same method used in Example 1 and the 5% white rust-forming time thereof was found to be 168 hours.

EXAMPLE 2

An aluminum alloy (A1100) plate (plate thickness: 0.3 mm; 100 mm×65 mm) was pre-treated in the usual manner, followed by immersing it in each rust proof film-forming solution No. 1 or No. 5 as specified in Table 1 at 25° C. for 60 seconds and then water-washing and drying the same.

The specimens thus treated were inspected for the corrosion resistance by the same method used in Example 1 and the 5% white rust-forming times thereof were found to be 48 hours (for the treatment with the solution No. 1) and 48 hours (for the treatment with the solution No. 5), respectively.

COMPARATIVE EXAMPLE 3

The same specimen used in Example 2 was immersed in the treating solution No. 13 or No. 15 used in Comparative Example 1 at 25° C. for 60 seconds, followed by water-washing and drying the same.

The specimens thus treated were inspected for the corrosion resistance by the same method used in Example 1 and the 5% white rust-forming times thereof were found to be 6 hours (for the treatment with the solution No. 13) and 6 hours (for the treatment with the solution No. 15), respectively.

EXAMPLE 3

A specimen which was prepared by applying a Zn plating film having a thickness of 8 to 10 μm onto an SPCC-polished steel plate (plate thickness: 0.3 mm; 100 mm×65mm) was immersed in the rust proof film-forming solution No. 1 or No. 5 as specified in Table 1 at 25° C. for 60 seconds, followed by withdrawing the specimen, water-washing and then applying a layer of "DIPCOAT W" (available from DIPSOL CHEMICALS CO., LTD.) as an organic resin overcoat.

The specimens thus treated were inspected for the corrosion resistance by the same method used in Example 1. The results obtained are summarized in the following Table 5.

TABLE 5

| Bath No. | 1 | | 5 | |
|---|---|---|---|---|
| DIPCOAT W Layer | Applied | Not Applied | Applied | Not Applied |
| 5% White Rust-Forming Time (hr) | 480 | 168 | 480 | 144 |

COMPARATIVE EXAMPLE 4

To the same specimen used in Example 3, there was directly applied a layer of "DIPCOAT W" (available from DIPSOL CHEMICALS CO., LTD.) as an overcoat of a water-soluble organic resin.

The specimen thus treated was inspected for the corrosion resistance by the same method used in Example 1 and the 5% white rust-forming time thereof was found to be 12 hours.

What is claimed is:

1. A liquid rust proof film-forming composition consisting essentially of (A) 0.001 to 3.0 mole/l of an oxidative substance, (B) 0.001 to 2.0 mole/l of a silicate and/or silicon dioxide, (C) 0.0001 to 0.5 mole/l of at least one member selected from the group consisting of metal cations of Ti, Zr, Ce, Sr, V, W and Mo; and oxymetal anions thereof, and a chelating agent selected from the group consisting of aliphatic amines, aminoalcohols, aminocarboxylic acids, hydroxycarboxylic acids, monocarboxylic acid and polyvalent carboxylic acids, said composition being free of chromium ions.

2. The composition of claim 1 wherein the oxidative substance is a peroxide and/or nitric acid.

3. The composition of claim 1 wherein the silicate is an alkali metal salt or ammonium salt of silicic acid.

4. The composition of claim 1 wherein the silicon dioxide is colloidal silica.

5. The composition of claim 1 wherein it has a pH ranging from 0.5 to 6.0.

6. A liquid rust proof film-forming composition consisting essentially of (A) 0.001 to 3.0 mole/l of a peroxide and/or nitric acid, (B) 0.001 to 2.0 mole/l of an alkali metal salt of silicic acid, ammonium salt of silicic acid or colloidal silica, (C) 0.0001 to 0.5 mole/l of at least one member selected from the group consisting of metal cations of Ti, Zr, Ce, Sr, V, W and Mo, a chelating component capable of solubilizing the metal ions in the liquid rust proof film-forming composition, said chelating component selected from the group consisting of aliphatic amines, aminoalcohols, aminocarboxylic acids, hydroxycarboxylic acids, monocarboxylic acid and polyvalent carboxylic acids, said composition being free of chromium ions.

7. The composition of claim 6 wherein the pH is 1.5 to 3.0.

8. A liquid rust proof film-forming composition consisting essentially of (A) 0.001 to 3.0 mole/l of a hydrogen peroxide, (B) 0.001 to 2.0 mole/l of a silicate, (C) 0.0001 to 0.5 mole/l of Ti ion, a chelating agent selected from the group consisting of aliphatic amines, aminoalcohols, aminocarboxylic acids, hydroxycarboxylic acids, monocarboxylic acid and polyvalent carboxylic acids, and a balance of water, a pH being 0.5 to 6.0, said composition being free of chromium ions.

9. The composition of claim 1, which is free of zinc.

* * * * *